United States Patent [19]

Morita et al.

[11] Patent Number: 4,817,570

[45] Date of Patent: Apr. 4, 1989

[54] METHOD OF AND APPARATUS FOR FUEL CONTROL

[75] Inventors: Kiyomi Morita, Katsuta; Junji Kiyake, Mito; Keiji Hatanaka, Chigasaki; Kiyotoshi Sakuma, Yokohama, all of Japan

[73] Assignee: Hitachi, Ltd., Tokyo, Japan

[21] Appl. No.: 91,874

[22] Filed: Sep. 1, 1987

[30] Foreign Application Priority Data

Sep. 1, 1986 [JP] Japan ..... 61-203712

[51] Int. Cl.[4] ..... F02D 41/34

[52] U.S. Cl. ..... 123/472; 123/486

[58] Field of Search ..... 123/486, 480, 472

[56] References Cited

U.S. PATENT DOCUMENTS 4,289,104 9/1981 Takada et al. ..... 123/472
4,301,780 11/1981 Hoshi ..... 123/486
4,501,250 2/1985 Omori et al. ..... 123/486
4,532,905 8/1985 Yokooku et al. ..... 123/480

FOREIGN PATENT DOCUMENTS 58-27827 2/1983 Japan ..... 123/472
59-91474 6/1984 Japan .

*Primary Examiner*—Andrew M. Dolinar
*Attorney, Agent, or Firm*—Antonelli, Terry & Wands

[57] ABSTRACT

A fuel is injected based on the rpm of the engine and the suction air rate. The fuel injection amount is corrected depending on a map of fuel injection share correction coefficient prepared in advance and determined by data such as a throttle valve opening and the rpm of the engine so that amounts of fuel injected will be even at the respective cylinders. The fuel injection share correction coefficient is for correcting fuel deviation due to construction of suction passage to with the respective cylinders or for correcting fuel deviation due to arrangement of two injectors in one bore with respect to the throttle valve shaft.

6 Claims, 2 Drawing Sheets

METHOD OF AND APPARATUS FOR FUEL CONTROL

BACKGROUND OF THE INVENTION

This invention relates to a method and apparatus for fuel control and, more particularly, to a method of and apparatus for fuel control capable of controlling a fuel injector so that an amount of fuel supplied into respective engine cylinders will be optimum.

In many fuel injection systems for automobile engines, an air passage from an air cleaner to respective engine cylinders is provided with a plurality of bore parts, for example, one bore part on the immediately downstream side of the air cleaner, and number of bore parts corresponding to the number of the engine cylinders on the manifold of the engine. A fuel injection system in which only one fuel injector is provided in a one bore part is, in the following description, designated as a one-bore one-injector system.

In, for example, Japanese Utility Model Laid Open Application No. 91474/1984, a one-bore one-injector system is proposed; however, when the system is applied to a multi-cylinder engine, the amount of fuel sucked or drawn into the respective cylinders scatter so that the operational control of the engine is insufficient.

Under the circumstances, a one-bore two-injector system in which two fuel injectors are provided in one bore part has been employed so that the fuel is supplied uniformly to respective cylinders. When a conventional one-bore two-injector system is applied to, for example, a four-cylinder engine, fuel is sucked four times and gaseous mixture is exploded four times per cycle (crank angle of 720°). While these four suction strokes and four explosion strokes are made, the fuel is ejected twice from one injector, and twice from the other injector. The fuel is ejected from these two injectors alternately at an equal rate. The two injectors are arranged on the upstream side of a throttle valve and on a plane crossing a shaft of the throttle valve due to the construction of the engine. Under such arrangement of the two injectors, when the degree of opening of the throttle valve is at a certain level, the fuel ejected from one injector is sucked 100% but the fuel injected from the other injector is sucked only 80%, so that the quantity of fuel in the respective cylindrs becomes unbalanced. Therefore, when a conventional one-bore two-injector system is employed, sufficient engine torque does not occur, and the exhaust characteristics become inferior with the gaseous mixture not being completely combusted.

As mentioned above, in the conventional fuel injection systems, an amount of fuel supplied to the respective engine cylinders is not uniformly set.

SUMMARY OF THE INVENTION

An object of the invention is to provide a method of and apparatus for fuel injection control, which are capable of uniformly setting a mixing ratio of an air fuel mixture supplied to respective cylinders.

In accordance with the present invention a fuel injection amount supplied by a fuel injector to the respective cylinders is corrected based on a map of fuel injection share correction coefficient obtained in advance and determined by a throttle valve opening and the number of revolutions of the engine so that the injector will supply the respective cylinders with fuel of an optimum amount.

DETAILED DESCRIPTION OF THE INVENTION

Figure 1:
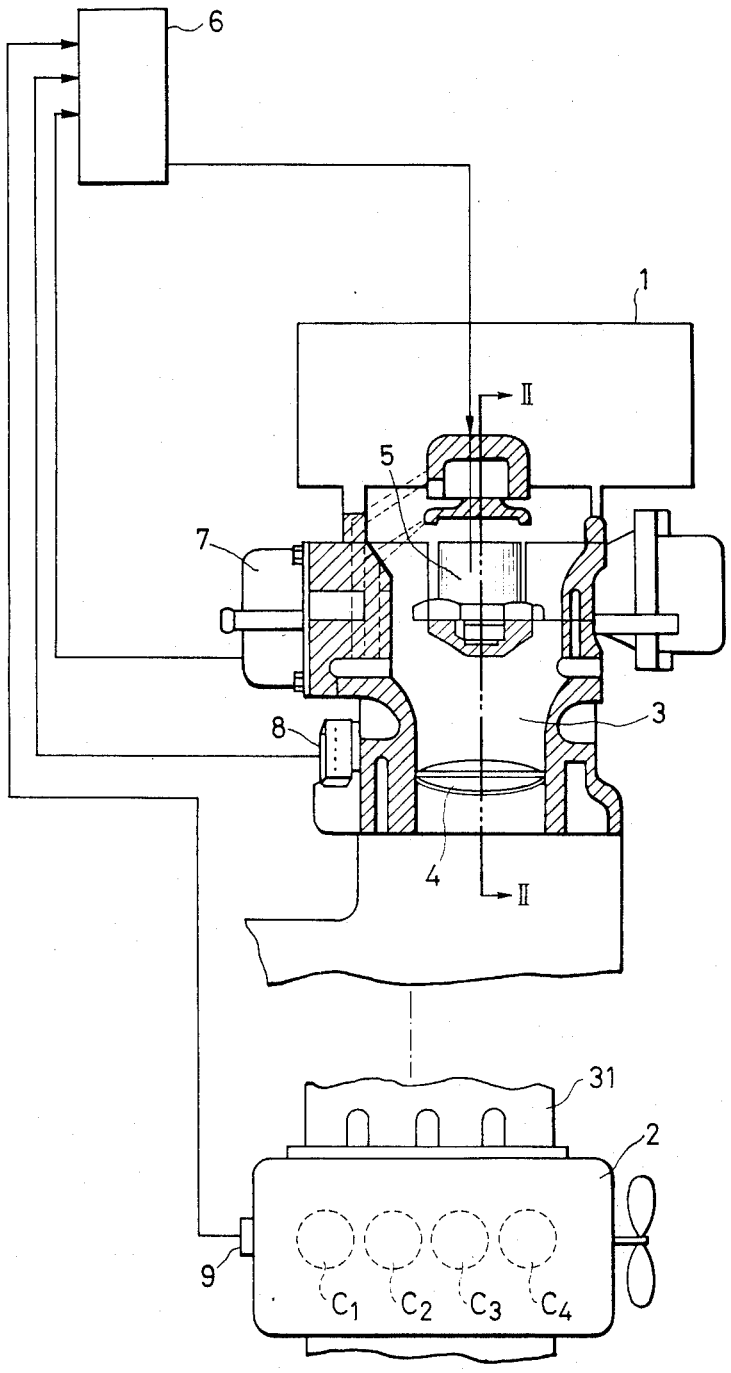
FIG. 1 is a schematic cross-sectional view of a fuel injection system with a carburetor of an motor vehicle internal combustion engine according to the present invention.

Referring now to the drawings wherein like reference numerals are used throughout the various views to designate like parts and, more particularly, to FIG. 1, according to this figure, an internal combustion engine 2 communicates with an air cleaner 1 by an intake passage 3 to draw or suck air therein through the air cleaner 1. The intake passage 3 has a portion formed in a manifold 31 through which air is supplied to the respective engine cylinders $C_1$, $C_2$, $C_3$, $C_4$ during a suction stroke thereof. A throttle valve is provided in the intake passage 3, and fuel injection means 5 are disposed on the an upstream side of the throttle valve 4.

Figure 2:
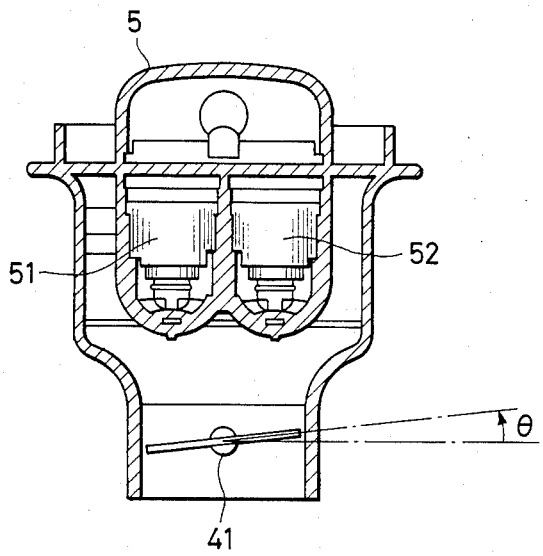
FIG. 2 is a sectional view taken along a line II—II in FIG. 1 and illustrating the fuel injectors.

As shown in FIG. 2, the fuel injection means 5 is provided with two fuel injectors 51, 52 which are arranged on a plane crossing a rotatable shaft 41 of the throttle valve 4 at an angle of about 90°. The two fuel injectors 51, 52 are disposed in one bore portion of the intake passage 3, so that this construction constitutes one bore two injector system.

In this construction, the throttle valve 4 is actuated by an accelerator pedal (not shown) to open and close the same. As the throttle valve 4 is opened, the engine 2 draws air through the intake passage 3 during the suction stroke of the respective cylinders.

The flow rate of the air drawn into the engine is measured with an air flow rate sensor 7, with a sensed value being inputted into a control unit 6. In the control unit 6, pulses outputted from a crank angle sensor 9, are counted to determine the number N of revolutions per unit time (rpm) of the engine 2, a feed rate of the fuel is calculated and output pulses corresponding to this feed rate are outputted to the injection means 5. The fuel is then ejected from the injection means 5 at a rate corresponding to the number of the pulses supplied thereto. Presuming Qa equals a suction rate of the air, and N an rpm of the engine 2, a basic width Tp of a pulse supplied to the injection means 5 can then be expressed by the following equation:

$$Tp = k \times Qa/N, \quad (1)$$

wherein: k is a constant.

On the other hand, outputs, which represent the degree of opening of the throttle valve 4, from a throttle sensor 8 are inputted the control unit 6 every T1 msec (for example, 10 msec) to determine the degree of opening in terms of the throttle valve 4 during T1 msec.

A fuel injection share correction coefficient $\alpha$ of fuel injection amounts from the fuel injectors 51, 52 is a value relating to fuel injection time correction, which is used in order that an air/fuel ratio in the cylinders supplied with fuel by one of the injectors and an air/fuel ratio in the other cylinder supplied with fuel by the other injector are made substantially even or optimum, respectively. The fuel injection share correction coefficient $\alpha$ of fuel injection amounts from the fuel injectors 51, 52 is determined in dependence upon the rpm N of the engine and the degree of opening $\theta$ of the throttle valve 4 and experimentally obtained in advance. Namely, under a certain throttle valve opening degree $\theta_1$ and a certain rpm N1 of the engine 2, an air/fuel ratio in the cylinders supplied with fuel from one of the fuel injectors 51, 52 and an air/fuel ratio in the other cylinders supplied with fuel from the other injectors are detected, and an amount of fuel injected from the respective injectors or injection time is adjusted so that the air/fuel ratios are optimum. The fuel injection share correction coefficient $\alpha$ at ($\theta$1, N1) is calculated based on the data. The operation is repeated so that fuel injection share correction coefficients are obtained on ($\theta$, N) all over the engine operation range.

Figure 3:
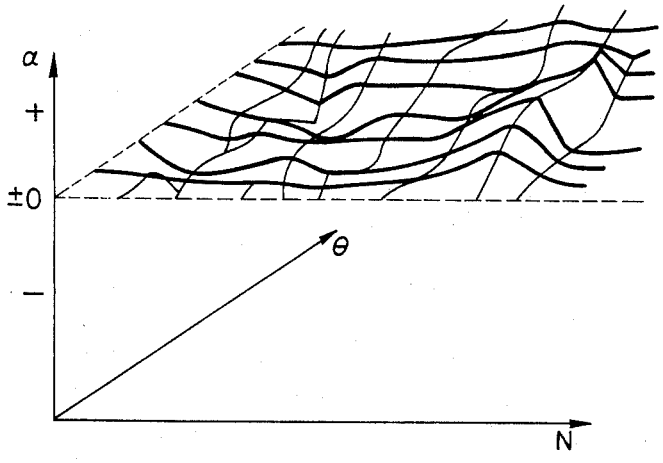
FIG. 3 is a map of fuel injection share correction coefficients according to the invention.

Such fuel injection share correction coefficients $\alpha$ of the fuel amount are stored in a map in the control unit 6 in advance, and a fuel injection share correction coefficient $\alpha$ on each occasion is determined by indexing the fuel injection share correction coefficient map, namely by indexing the detected rpm N of the engine 2 and the detected throttle valve opening degree $\theta$. This fuel injection share correction coefficient map is as shown in FIG. 3.

Accordingly, for example, the width Ti1 of a pulse supplied to the injector 51 is expressed by the following equation:

$$Ti1 = Te(1+\alpha)+Ts \quad (2)$$

wherein: Ts=quantity of correction of voltage;
$\alpha$=a share correction coefficient of the fuel fed from the injectors 51, 52; and
Te is obtained by the equation;

$$Te = Tp \times (1+COEF),$$

wherein:

COEF=a correction factor.

The width Ti2 of a pulse supplied to the injector 52 is expressed by the following equation:

$$Ti2 = Te(1-\alpha)+Ts.$$

$$Ti2 = Te(1-\alpha)+Ts \quad (3)$$

The sum of the widths of pulses supplied to these two injectors 51, 52 corresponds to a fuel injection amount from the two injectors 51, 52 which are equal to each other in fuel injection amount.

In a multi-cylinder engine, for example, a four cylinder engine as shown in FIG. 1, air and fuel are supplied for the respective cylinders C1, C2, C3 and C4 through the suction passage with the manifold. The passages from the fuel injection means 5 which may be one injector or two or more injectors to the respective cylinders C1, C2, C3, C4 are different in shape and size, so that even if a constant amount of fuel is injected by the injection means 5, the respective cylinders C1, C2, C3, C4 receive a different amount of fuel, and an A/F ratio differs at the respective cylinders. Therefore, it is desirable to correct fuel injection amount for the respective cylinders in view of the receiving amount of fuel or the A/F ratio at the respective cylinders.

The pulse widths of the fuel injection are given by the following equations:

$$Ti1 = Te(1+C1)+Ts$$

$$Ti2 = Te(1+\alpha C2)+Ts$$

$$Ti3 = Te(1+\alpha C3)+Ts \quad (4)$$

$$Ti4 = Te(1+\alpha C4)+Ts$$

wherein:
Ti1 to Ti4 are pulse widths corresponding to cylinders $C_1$ to $C_4$; and
$\alpha$C1 to $\alpha$C4 are fuel injection share correction coefficients corresponding to the cylinders C1 to C4.

The fuel injection share correction coefficients $\alpha$C1 to $\alpha$C4 each vary depending on throttle valve opening degrees and the rpm of the engine as shown in FIG. 3 and the stored as a map. The fuel injection share correction coefficient $\alpha$C1 to $\alpha$C4 each are obtained through experiments. For example, fuel is supplied to the engine under conditions of a certain rpm N and a certain throttle valve opening degree $\theta$so that a fuel amount will be optimum at the cylinder.

The amount of injected fuel or fuel injection pulse width is detected and $\alpha$C1 is determined based on the detected fuel amount according to the equation (4). Experiments such as above are conducted all over operational regions and the obtained data on $\alpha$ are stored in a map in the control unit 6. According to this embodiment, $\alpha$ value has four values in the four cylinder engine at the same rpm and the same throttle valve opening degree $\theta$. Therefore, the $\alpha$ value is read out by indicating the cylinder number, the rpm and the throttle valve opening degree and the fuel is injected with the injection pulse width being corrected to the $\alpha$.

What is claimed is:

1. A fuel control method for an internal combustion engine provided with a fuel injection system comprising an intake passage communicating with an air cleaner and cylinders of the engine, a throttle valve pivotally mounted around a throttle valve shaft, and two fuel injectors arranged on a plane crossing said throttle valve shaft at right angles and on a upstream side of said throttle valve so that said throttle valve shaft is disposed between said two injectors, the method comprising the steps of:

obtaining, from a map, fuel injection share correction coefficient, based on an opening position of the throttle valve and revolutions per unit time of said engine;

correcting amounts of fuel to be injected by said respective fuel injectors in dependence upon said fuel injection share correction coefficient so that the fuel amount to be injected by one of said fuel injectors increases by an amount determined on a basis of said fuel injection share correction coefficient and the fuel amount to be injected by the other said fuel injectors decreases by the same amount as the same of fuel increases; and injecting an amount of fuel determined by the above step into said intake passage by said fuel injectors, alternately, so that the cylinders each receive an optimum amount of fuel.

2. The method according to claim 1, wherein a sum of said fuel amounts supplied by said two fuel injectors corresponds to a fuel injection amount from two injectors which are equal to each other in fuel injection amount.

3. A method of fuel control for an internal combustion engine with an intake passage for introducing air from an air cleaner into the engine, said intake passage having a throttle valve pivotable around a throttle valve shaft and two fuel injectors arranged upstream of said throttle valve in parallel to an air flow so as to be positioned on opposite sides of said throttle valve shaft, the method comprising the steps of obtaining the amounts of fuel for the two fuel injectors based on a fuel injection share correction coefficient stored in advance in a map and determined by data including an opening of the throttle valve and number of revolutions of the engine per unit time, and injecting fuel by said two fuel injectors alternately on the basis of the obtained fuel injection coefficient so that the respective engine cylinders are supplied with an optimum fuel supply.

4. The fuel control method according to claim 3, wherein said two fuel injectors each inject an amount of fuel determined in accordance with the following relationship:

$$Ti1 = Te(1+\alpha) + Ts,$$

$$Ti2 = Te(1-\alpha) + Ts,$$

wherein:

Ti1 and Ti2 are pulse widths for fuel injection in said two fuel injectors, respectively, Te is a pulse width determined on a value obtained by a suction air flow rate and rotational speed of the engine, Ts is a correction coefficient; and $\alpha$ is the fuel injection share correction coefficient.

5. A fuel control apparatus for an internal combustion engine provided with a fuel injection system comprising an intake passage communicating with an air cleaner and cylinders of the engine, a throttle valve disposed in the intake passage so as to be pivotable around a throttle valve shaft, and two fuel injectors arranged on a plane crossing the throttle valve shaft at right angles and on a upstream side of said throttle valve so that the throttle valve shaft is disposed between the two injectors, the apparatus comprising:

means for reading, from a map, fuel injection share correction coefficient, based on an opening of the throttle valve and the number of revolutions per unit of time of the engine; and means for correcting the amounts of fuel to be injected by the respective fuel injectors in dependence upon said fuel injection share correction coefficient so that the fuel amount to be injected by one of said fuel injectors increases by an amount determined on the basis of said fuel injection share correction coefficient and the fuel amount to be injected by the other of said fuel injectors decreases by the same amount as the amount of the fuel increase.

6. A fuel control apparatus according to claim 5, wherein the sum of said fuel amounts supplied by said two fuel injectors correspond to a fuel injection amount from two injectors which are equal to each other in fuel injection amount.

* * * * *